United States Patent [19]

Deck et al.

[11] Patent Number: 4,640,791

[45] Date of Patent: Feb. 3, 1987

[54] WATER-BASED FUNCTIONAL FLUIDS THICKENED BY THE INTERACTION OF AN ASSOCIATIVE POLYETHER THICKENER AND CERTAIN FATTY ACID AMIDES

[75] Inventors: Charles F. Deck, Trenton; James E. Carson, Lincoln Park, both of Mich.

[73] Assignee: BASF Corporation, Wyandotte, Wis.

[21] Appl. No.: 696,406

[22] Filed: Jan. 30, 1985

[51] Int. Cl.[4] ..... C10M 173/00; C10M 119/18; C10M 133/16

[52] U.S. Cl. ..... 252/75; 252/49.3; 252/51.5 R; 252/52 A; 252/76; 252/77; 252/79

[58] Field of Search ..... 252/49.3, 51.5 R, 52 A, 252/76, 75, 77, 79

[56] References Cited

U.S. PATENT DOCUMENTS

| | | | |
|---|---|---|---|
| 4,288,639 | 9/1981 | Camp | 568/608 |
| 4,312,775 | 1/1982 | Panek et al. | 568/624 |
| 4,342,658 | 8/1982 | Tincher et al. | 252/49.3 |
| 4,411,819 | 10/1983 | Panek et al. | 568/624 |

FOREIGN PATENT DOCUMENTS

| | | | |
|---|---|---|---|
| 131657 | 1/1985 | European Pat. Off. . | |
| 62895 | 5/1981 | Japan . | |
| 96698 | 6/1983 | Japan | 252/524 |
| 122993 | 7/1983 | Japan . | |

*Primary Examiner*—Robert A. Wax

*Attorney, Agent, or Firm*—Bernhard R. Swick

[57] ABSTRACT

The invention relates to a water-based functional fluid thickened by an associative polyether thickener whose thickening ability is enhanced by the addition of certain fatty acid amides.

6 Claims, No Drawings

WATER-BASED FUNCTIONAL FLUIDS THICKENED BY THE INTERACTION OF AN ASSOCIATIVE POLYETHER THICKENER AND CERTAIN FATTY ACID AMIDES

BACKGROUND OF THE INVENTION

1. Field of the Invention

This invention relates to water-based functional fluids thickened by an associative polyether thickener whose thickening power is enhanced by the addition of certain fatty acid amides.

2. Description of the Prior Art

U.S. Pat. No. 4,411,819 discloses the advantages of using associative polyether thickeners to thicken water-based functional fluids. Although these thickeners have excellent thickening ability, they are expensive and new methods for decreasing the amount of such thickeners have been explored. For instance, U.S. Pat. No. 4,312,775 discloses that reduced amounts of associative polyether thickener can be used in conjunction with ethoxylated phosphate ester.

SUMMARY OF THE INVENTION

The subject invention relates to a functional fluid comprising (a) from about 60.0 percent by weight to about 99.0 percent by weight of a diluent;

(b) from about 1.0 percent by weight to about 25.0 percent by weight of a thickener component comprising in effective amounts (i) an associative polyether thickener, and (ii) a fatty acid amide having the following chemical structure:

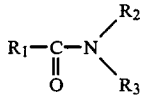

wherein $R_1$ is individually an alkyl radical having 8 to 18 carbon atoms and $R_2$ and $R_3$ are individually selected from the group consisting of alkyl and hydroxyalkyl radicals having 1 to 4 carbon atoms.

The addition for the fatty acid amide enhances the thickening ability of the associative polyether thickener so that it is not only possible to use less associative polyether thickener without reducing the viscosity of the fluid, but it is possible to increase the viscosity of the fluid.

The functional fluids can be used in hydraulic systems or as metalworking compositions to cool and lubricate surfaces which are in frictional contact during operations such as the turning, cutting, peeling, or the grinding of metals. The fluids are prepared in general by mixing the thickening component with water in the required proportions. The diluent used is water, but some of it may be replaced by a freezing point lowering additive such as ethylene glycol, propylene glycol, butylene glycol, diethylene glycol, dipropylene glycol, triethylene glycol, tetraethylene glycol, and the like, or mixtures thereof.

DESCRIPTION OF THE PREFERRED EMBODIMENTS

The associative polyether thickeners which are used in the thickening component are relatively new in the art and are disclosed in U.S. Pat. Nos. 4,288,639; 4,312,775; and 4,411,819 which are incorporated herein by reference. These thickeners are prepared by first reacting ethylene oxide or ethylene oxide and generally at least one lower alkylene oxide with at least one active hydrogen-containing compound and subsequently reacting therewith at least one long chain aliphatic alpha-olefin epoxide or glycidyl ether. The long chain alpha-olefin epoxide or glycidyl ether has a carbon chain length of about 12 to about 18 aliphatic carbon atoms. The proportion of alpha-olefin epoxide or glycidyl ether present in the polyether thickener is generally 1 to about 20 percent by weight, based upon the total weight of the thickener.

The associative polyether thickeners may be readily prepared by modifying a conventional non-associative polyether aqueous thickener by reacting it with an alpha-olefin epoxide or glycidyl ether having about 12 to about 18 carbon atoms or mixtures thereof. The conventional nonassociative polyether polyol thickener can be an ethylene oxide-derived homopolymer or a heteric or block copolymer of ethylene oxide and at least one lower alkylene oxide preferably having 3 to 4 carbon atoms. The ethylene oxide is used generally as a reactant in the proportion of at least 10 percent by weight based upon the total weight of the polyether thickener. Preferably, about 60 to 99 percent by weight ethylene oxide is utilized with about 40 to 1 percent by weight of a lower alkylene oxide preferably having 3 to 4 carbon atoms.

The preferred nonassociative polyether thickeners used to prepare the associative thickeners are prepared by methods well known in the art. Generally this involves reacting an active hydrogen-containing compound in the presence of an acidic or basic oxyalkylation catalyst and an inert organic solvent at elevated temperatures in the range of about 50° C. to 150° C. under an inert gas pressure, generally from about 20 to about 100 pounds per square inch gauge. Generally, both monohydric and polyhydric alcohol initiators are useful. Useful polyhydric alcohol initiators are selected from the alkane polyols, alkene polyols, alkyne polyols, aromatic polyols, and oxyalkylene polyols. Monohydric alcohol initiators which are useful include aliphatic monohydric alcohols and alkyl phenols containing about 12 to about 18 carbon atoms in the aliphatic or alkyl group. In addition, aliphatic mercaptans having about 12 to about 18 carbon atoms are useful initiators.

In this manner, heteric, block, and homopolymer nonassociative polyether thickeners, preferably having average molecular weights of about 1,000 to about 60,000, preferably 5,000 to 40,000, are prepared which can be used to prepare associative polyether thickeners by reacting them with long chain, aliphatic alpha-olefin epoxides or glycidyl ethers.

The fatty acid amides which are used in the thickening component of the subject concentrates and fluids are well known in the art and are commerically available. They have the following chemical structure:

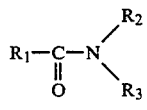

wherein $R_1$ is individually an alkyl radical having 8 to 18 carbon atoms, and $R_2$ and $R_3$ are selected from the group consisting of alkyl hydroxyalkyl radicals having 1 to 4 carbon atoms.

Specific examples of such fatty acid amides are stearic acid diethanolamide and lauric acid diethanolamide.

The thickener component is used in amount of from about 1 percent by weight to about 25 percent by weight based upon the total weight of the functional fluid. The weight ratio of the associative polyether thickener to the fatty acid amide in the thickener component is such as to provide the thickening needed for the particular application. For economic reasons, it is preferable to use lower amounts of the associative polyether thickener if possible. Generally, the weight ratio of associative polyether thickener is about 10:1 to about 1:10, preferably from about 5:1 to about 1:5.

The functional fluids may also contain several optional ingredients, for instance, corrosion inhibitors, metal deactivators, and wear additives, which may be useful for specific applications.

Corrosion inhibitors which may be used include alkanolamines; other amines such as morpholine, N-methylmorpholine, ethylenediamine, and piperazine; nitrates; nitrites; phoshates; silicates; and benzoates.

Metal deactivators which may be used include triazoles and thiazoles.

Wear additives which may be used in the subject fluids include those described in U.S. Pat. No. 4,257,902, which is hereby incorporated into this application by reference This list of additional ingredients is not intended to preclude the use of other ingredients, but is merely designed to indicate that other optional ingredients may be used. Those skilled in the art will know what optional ingredients are likely to work and in what proportions for the specific problem to be solved.

The following examples will provide specific formulations and data regarding their thickening ability. The viscosities are in centistokes (cSt) and were measured at 100° F. by Cannon-Fenske capillary method unless otherwise indicated.

In the examples which follow, the following abbreviations will be used:

APT—an associative polyether thickener having an average molecular weight of approximately 17,000 prepared by reacting trimethylpropane with a mixture of ethylene oxide and propylene oxide (weight ratio of ethylene oxide to propylene oxide of approximately 85:15) to form a heteric intermediate, and then reacting the intermediate with approximately 4 to 5 weight percent of a mixture of $C_{15}$–$C_{18}$ alpha olefin epoxides.

FA 1—MONOLUBE 29-78 which is a coco fatty acid diethanolamide sold by Mono Industries, Inc.

FA 2—CALAMIDE C which is a coco fatty acid diethanol amide sold by Pilot Chemical Company.

FA 3—MONAMID ADD which is a coco diethanolamide sold by Mono Industries, Inc.

FA 4—MONOAMID 150 MW which is a myristic acid diethanolamide sold by Mono Industries, Inc.

COMPARISON EXAMPLE

A fluid containing 3 percent by weight of APT in water was prepared which had a viscosity of 12 cSt at 100° F. A fluid containing 4 percent by weight of APT in water was also prepared which had a viscosity of 70 cSt at 100° F. Four fluids containing 1 percent by weight of FA-1, FA-2, FA-3, and FA-4 in water were also prepared, each of which had a viscosity of approximately 1 cSt, which is approximately the viscosity of water.

EXAMPLES 1–3

In these examples, fluids were prepared containing 1 percent by weight of FA-1, FA-2, FA-3, and FA-4; 3 percent by weight APT; and 96 percent by weight of water. The viscosity of the fluid containing FA-1 was 315 cSt; the viscosity of the fluid containing FA-2 was 374 cSt; the viscosity of the fluid containing FA-3 was 348 cSt; and the viscosity of the fluid containing FA-4 was 118 cSt.

The results of the comparative experiments and Examples 1–3 can be summarized as follows:

| Fluid | Viscosity (cSt at 100° F.) |
|---|---|
| Water only | 1 |
| Water + FA-1, 2, 3, or 4 | 1 |
| Water + 3% APT | 12 |
| Water + 4% APT | 70 |
| Water + 3% APT + 1% FA-1, FA-2, FA-3, or FA-4 | 118–374 depending upon the fatty acid amide used |

This summary illustrates the beneficial effect, in terms of viscosity, of using a thickener component containing an associative polyether thickener and a fatty acid amide as defined by the subject invention.

The embodiments of the invention in which an exclusive privilege or property is claimed are defined as follows:

1. A functional fluid comprising (a) from about 60.0 percent by weight to about 99.0 percent by weight of a diluent;

(b) from about 1.0 percent by weight to about 25.0 percent by weight of a thickener component comprising in effective amounts (i) an associative polyether thickener, and (ii) a fatty acid amide having the following chemical structure:

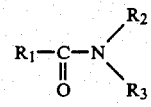

wherein $R_1$ is individually an alkyl radical having 8 to 18 carbon atoms, and $R_2$ and $R_3$ are individually hydroxyalkyl radicals having 1 to 4 carbon atoms.

2. The fluid of claim 1 wherein the associative polyether thickener is an associative polyether thickener having a molecular weight of about 1,000 to about 60,000 prepared by reacting ethylene oxide or ethylene oxide and at least one lower alkylene oxide with at least one active hydrogen-containing compound containing at least one active hydrogen and at least one long chain aliphatic alpha-olefin oxide or long chain aliphatic glycidyl ether each having a carbon chain length of about 12 to about 18 carbon atoms and wherein said alpha-olefin oxide or glycidyl ether is present in an amount of about 1 to about 20 percent by weight based upon the total weight of the thickener.

3. The fluid of claim 2 wherein the ratio of (i) to (ii) is from 5:1 to 1:5.

4. The fluid of claim 3 wherein a wear additive and corrosion inhibitor are also components of the fluid.

5. The fluid of claim 4 wherein the associative polyether thickener is an associative thickener having an average molecular weight of 5,000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

6. The fluid of claim 5 wherein the fatty acid amide is a reaction product of coco fatty acid and diethanolamine.

* * * * *